US011365856B1

(12) United States Patent
Ouyang et al.

(10) Patent No.: US 11,365,856 B1
(45) Date of Patent: Jun. 21, 2022

(54) PROJECTION NIGHT LIGHT

(71) Applicant: SHENZHEN HUIJING TECHNOLOGY CO., LTD, Shenzhen (CN)

(72) Inventors: Zuhui Ouyang, Hunan (CN); Biao Xia, Hunan (CN); Minghua Yang, Sichuan (CN)

(73) Assignee: SHENZHEN HUIJING TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 17/489,329

(22) Filed: Sep. 29, 2021

(30) Foreign Application Priority Data

Aug. 27, 2021 (CN) ..... 202122053589.X

(51) Int. Cl.
*F21S 10/00* (2006.01)
*F21V 5/04* (2006.01)
*F21V 3/00* (2015.01)

(52) U.S. Cl.
CPC ..... *F21S 10/007* (2013.01); *F21V 3/00* (2013.01); *F21V 5/04* (2013.01); *Y10S 362/806* (2013.01)

(58) Field of Classification Search
CPC .. F21S 10/007; F21V 3/00; F21V 5/04; F21V 19/005; Y10S 362/806; Y10S 362/807; F21W 2121/008
See application file for complete search history.

(56) References Cited

U.S. PATENT DOCUMENTS

| | | | | |
|---|---|---|---|---|
| 11,041,596 | B1 * | 6/2021 | Zhang | F21V 5/04 |
| 2013/0051050 | A1 * | 2/2013 | Yang | F21S 43/245 362/509 |
| 2020/0025345 | A1 * | 1/2020 | Liu | F21V 21/22 |
| 2021/0247039 | A1 * | 8/2021 | Zheng | F21S 10/007 |

* cited by examiner

*Primary Examiner* — Y M. Quach Lee
(74) *Attorney, Agent, or Firm* — Muncy, Geissler, Olds & Lowe, PC

(57) ABSTRACT

The invention discloses a projection night light, comprising a shell, and a projection component and a lighting component arranged in the shell, wherein the projection component comprises a first lamp bead and an aurora cover covered on the first lamp bead; the lighting component comprises second lamp beads and a diffuser covered on the second lamp beads; the diffuser is in a ring shape and is arranged around the aurora cover; the center of the shell is provided with an opening; the aurora cover and the diffuser extend out of the shell from the opening. The lighting component of the projection night light of the invention is arranged around the projection component so that the light paths of the two will not affect each other, which allows the invention to have a variety of different ways of use: create atmosphere for users, decorate the room, assist sleep, etc.

10 Claims, 6 Drawing Sheets

PROJECTION NIGHT LIGHT

BACKGROUND OF THE INVENTION

1. Field of the Invention

The invention relates to the technical field of lamps, in particular to a projection night light.

2. Description of the Related Art

Night lights are often used for lighting in sleep or dimly lit environments. The soft light can not only provide lighting for people who wake up at night, but also prevent excessive light from affecting people's sleep, and is becoming more and more popular. However, most of the night lights on the market only have a single lighting function, and the light emitted is extremely monotonous, which cannot play the role of creating atmosphere, decorating the room, helping sleep, etc., thus needs to be further improved.

SUMMARY OF THE INVENTION

In view of this, the invention provides a multifunctional projection night light to solve the problem that the current night light can only illuminate.

A projection night light, comprising a shell, and a projection component and a lighting component arranged in the shell, wherein the projection component comprises a first lamp bead and an aurora cover covered on the first lamp bead; the lighting component comprises second lamp beads and a diffuser covered on the second lamp beads; the diffuser is in a ring shape and is arranged around the aurora cover; the center of the shell is provided with an opening; the aurora cover and the diffuser extend out of the shell from the opening.

Compared with the prior art, the projection night light of the invention is equipped with a projection component and a lighting component, wherein the lighting component is arranged around the projection component so that the light paths of the two will not affect each other. In addition, the match of the lamp cover allows the invention to have a variety of different ways of use. The detachable connection of the lamp cover and the shell makes the switching of various modes simple and convenient, which can conveniently create atmosphere for users, decorate the room, assist sleep, etc., and is worthy of vigorous promotion and use.

SYMBOL DESCRIPTION

Figure 1:
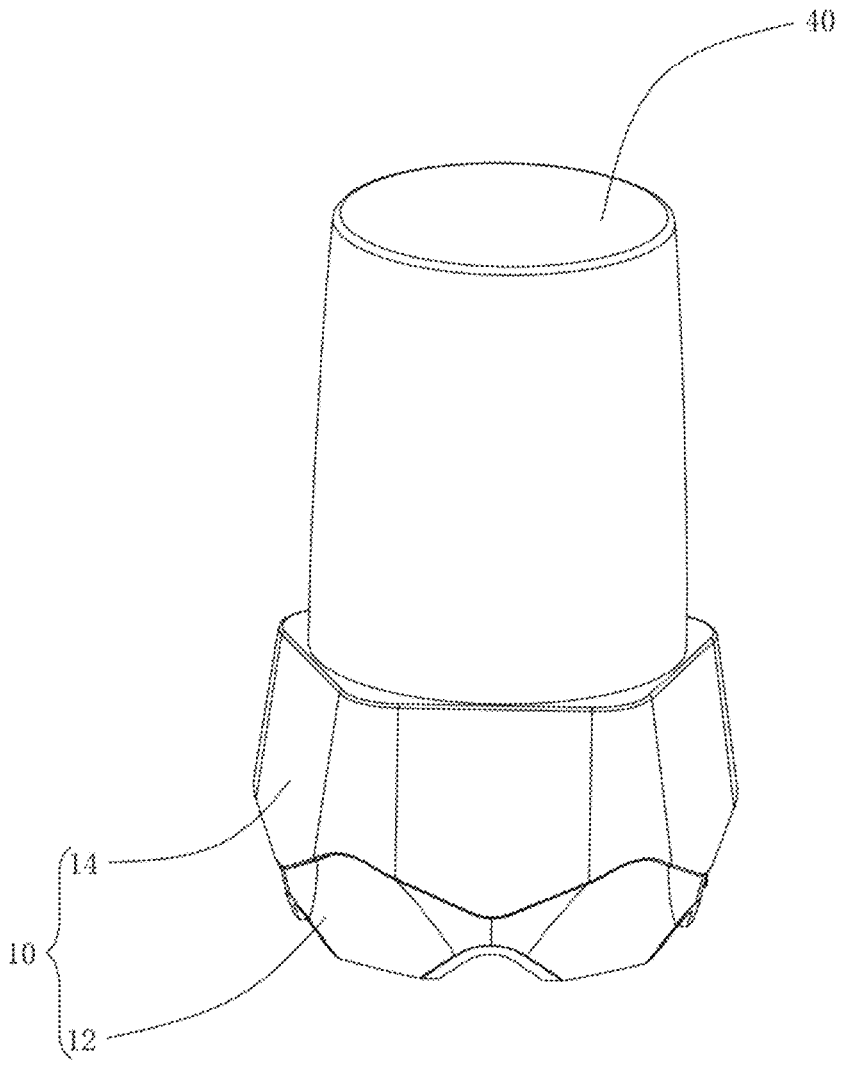
FIG. 1 is a schematic structural diagram of an embodiment of the projection night light according to the invention.

10 refers to the shell; 12 refers to the bottom shell; 120 refers to the fixing hole; 14 refers to the upper shell; 140 refers to the fixing column; 142 refers to the opening; 144 refers to the second convex column; 146 refers to the clamping block; 16 refers to the supporting part; 18 refers to the non-slip mat;

20 refers to the projection component; 22 refers to the first lamp bead; 23 refers to the first circuit board; 230 refers to the connecting hole; 24 refers to the condenser lens; 25 refers to the bracket; 250 refers to the supporting leg; 26 refers to the aurora sheet; 28 refers to the aurora cover; 281 refers to the first folding; 283 refers to the first perforation; 29 refers to the motor;

30 refers to the lighting component; 32 refers to the second lamp bead; 34 refers to the diffuser; 341 refers to the inner plate; 342 refers to the first convex column; 343 refers to the outer plate; 345 refers to the top plate; 347 refers to the second folding; 348 refers to the mounting part; 349 refers to the third perforation; 36 refers to the second circuit board; 361 refers to the second perforation;

40 refers to the lamp cover; 42 refers to the clamping slot; 44 refers to the first notch; 46 refers to the second notch;

50 refers to the main control circuit board; 52 refers to the sounding device.

DETAILED DESCRIPTION OF THE PREFERRED EMBODIMENTS

In order to facilitate the understanding of the invention, the invention will be described in a more comprehensive manner hereinafter with reference to the drawings. One or more embodiments of the invention are exemplarily given in the drawings, so as to make the understanding of the technical solutions disclosed by the invention more accurate and thorough. However, it should be understood that the invention can be implemented in many different forms and is not limited to the embodiments described hereinafter.

The same or similar reference numbers in the drawings of the invention correspond to the same or similar parts. In the description of the invention, it needs to be understood that the orientation or positional relationship indicated by the terms "up", "down", "left", "right", etc. are based on the orientation or positional relationship shown in the drawings, which are only for the convenience of describing the invention and simplifying the description, rather than indicating or implying that the device or element referred to must have a specific orientation, be constructed and operated in a specific orientation, and therefore cannot be understood as a limitation of the invention. For those of ordinary skill in the art, the specific meaning of the above terms can be understood according to specific circumstances.

Figure 2:
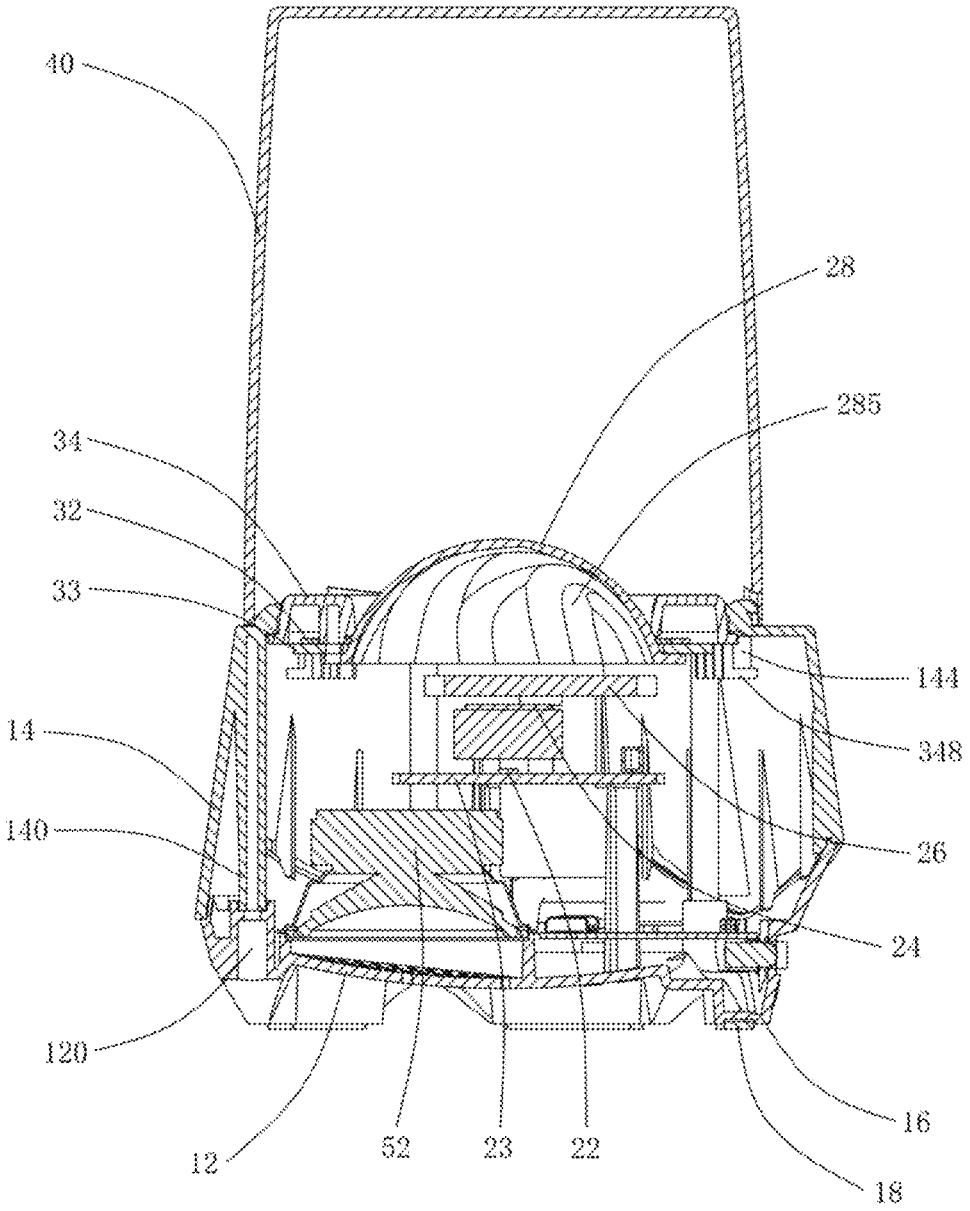
FIG. 2 is a cross-sectional view of the projection night light shown in FIG. 1.
Figure 3:
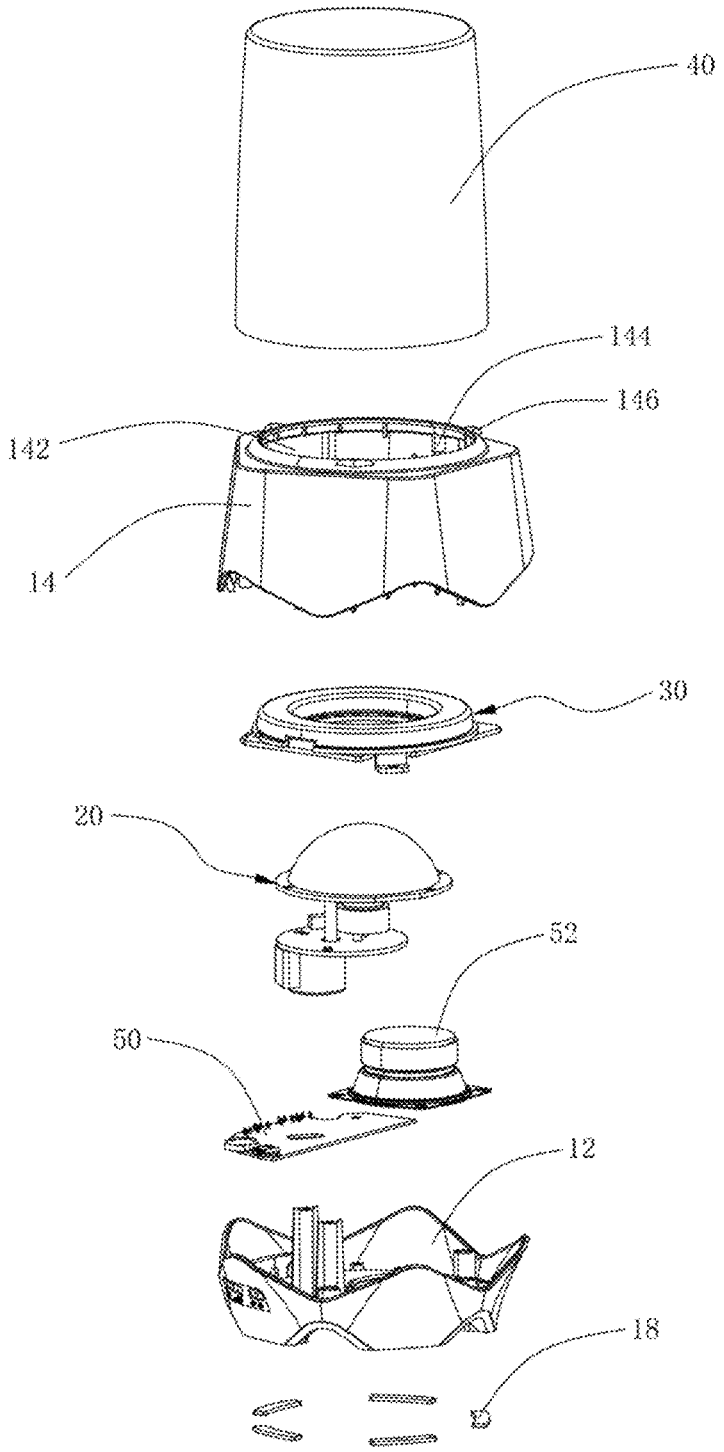
FIG. 3 is an exploded view of the projection night light shown in FIG. 1.

FIGS. 1-3 shows a specific embodiment of the projection night light of the invention. The projection night light shown comprises a shell 10, a projection component 20 and a lighting component 30 arranged in the shell 10, and a lamp cover 40 connected to the front end of the shell 10.

The shell 10 is preferably a plastic shell, which can effectively reduce the weight of the entire projection night light and make the product lighter. In the embodiment, the shell 10 is composed of a bottom shell 12 and an upper shell 14. The bottom shell 12 is provided with fixing holes 120 penetrating therethrough, and the inner wall of the upper shell 14 is provided with a fixing column 140 corresponding to each fixing hole 120. A screw hole or a round hole is formed in the fixing column 140. Fixing parts such as screws and pins pass through the fixing holes 120 of the bottom shell 12 and are screwed or tightly connected to the fixing column 140 of the upper shell 14 to connect the bottom shell 12 and the upper shell 14 together. Preferably, a plurality of supporting parts 16 are formed protruding downward from the edge of the bottom shell 12, so that the projection night light can be stably placed on supports such as a table, a bedside table, etc., and used as a table lamp. Preferably, a non-slip mat 18, such as a silicone pad, is attached to the bottom surface of the supporting part 16, to increase friction with the support, so that the projection night light of the invention is safer during use.

Figure 4:
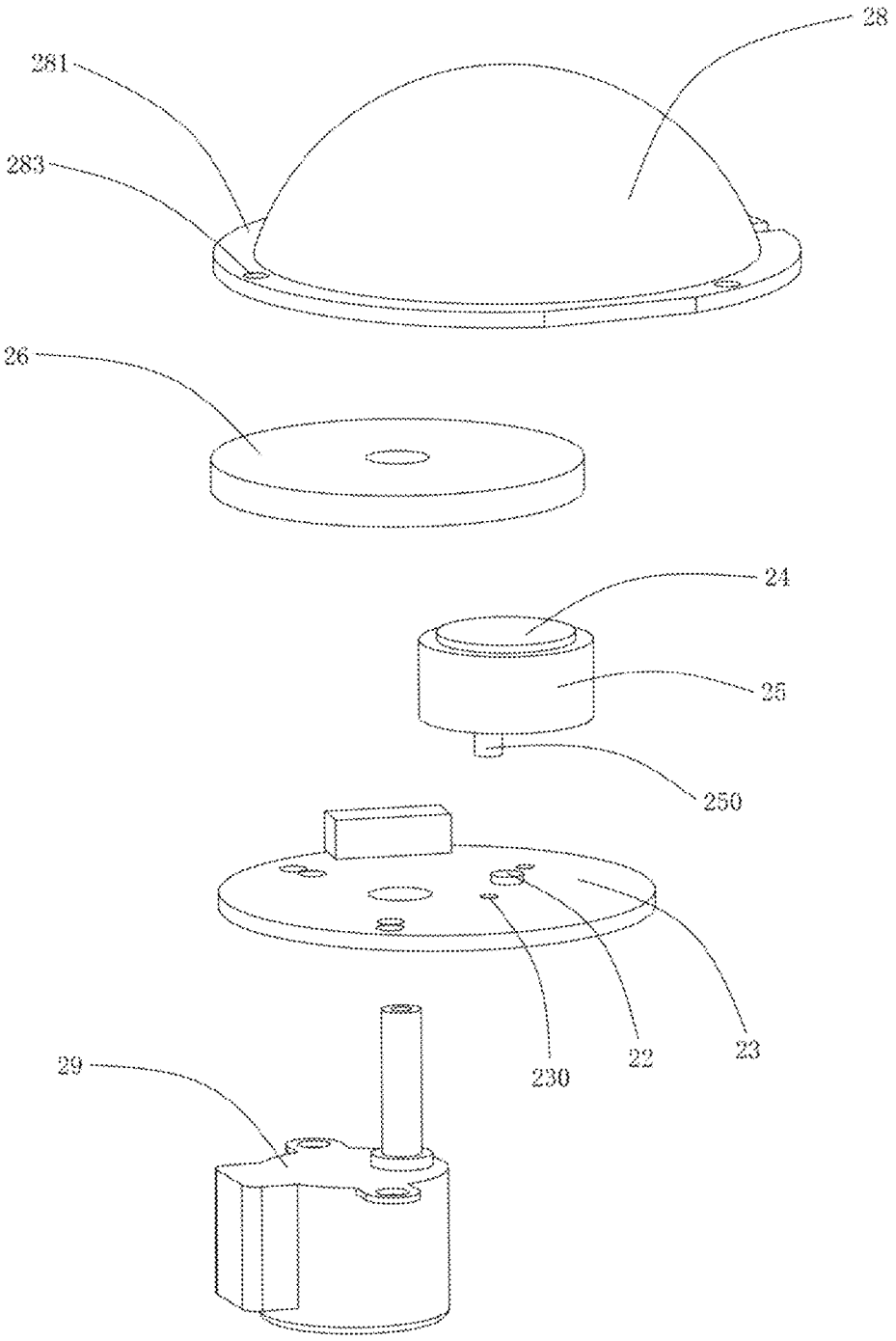
FIG. 4 is a further exploded view of the projection night light shown in FIG. 3.
Figure 5:
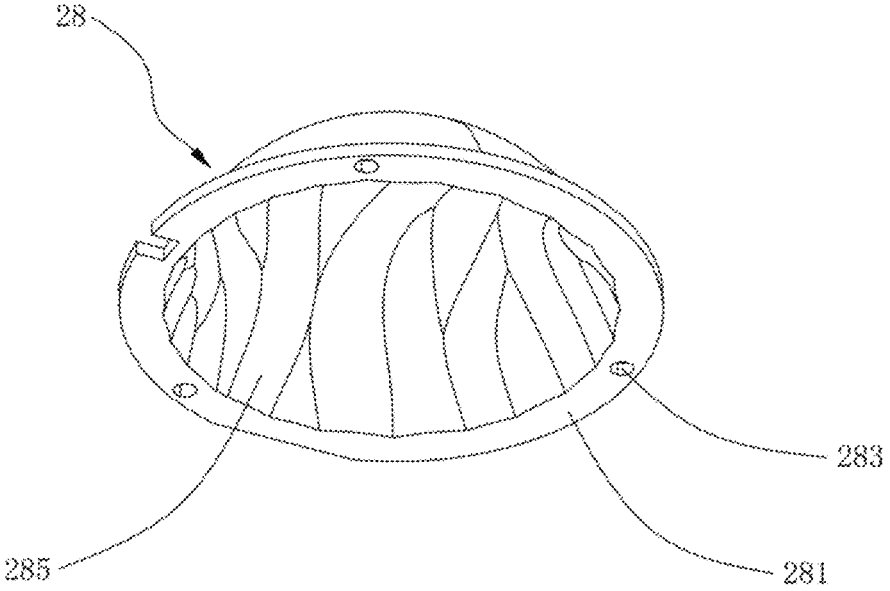
FIG. 5 is another angled view of the aurora cover of the projection component shown in FIG. 4.

The projection component 20 is used to project desired patterns, text, etc. on the wall, the ground, etc., such as projecting the starry sky in a sleeping room, projecting flames on the beach, etc., which can play the role of rendering the atmosphere, decorating the space, and assisting sleep. As shown in FIGS. 4 and 5, the projection component 20 comprises a first lamp bead 22, a condenser lens 24, an aurora sheet 26 and an aurora cover 28 arranged in order from bottom to top.

The first lamp bead 22 is preferably an LED lamp bead, and is fixedly connected to the first circuit board 23 by wire bonding or the like. The condenser lens 24 is arranged directly above the first lamp bead 22 to condense the light emitted by the first lamp bead 22. In some specific embodiments, the condenser lens 24 may be a spotlight cup lens, a plano-convex lens, a spherical lens, or the like. In the embodiment, the condenser lens 24 is fixedly connected to the first circuit board 23 through a bracket 25, and the condenser lens 24 is arranged in the center of the bracket 25, and the two can be fixed by bonding, tight fitting, etc.; the bottom of the bracket 25 extends toward the first circuit board 23 to form a supporting leg 250, and correspondingly the first circuit board 23 is provided with a connecting hole 230; the supporting leg 250 is inserted into the connecting hole 230 to fix the bracket 25 and the first circuit board 23. In order to ensure the stability of the support, the number of the supporting legs 250 and the connecting holes 230 is preferably more than one.

The aurora sheet 26 is a flat plate structure with a plurality of plano-convex lenses arranged on its surface. The plano-convex lenses have different sizes and irregular shapes. The focal lengths of the plano-convex lenses are different and the size is smaller than the diameter of the lens. The aurora cover 28 has a hemispherical structure as a whole, and covers directly above the aurora sheet 26. An opening 142 is formed in the center of the upper shell 14, and the aurora cover 28 extends outward through the opening 142. As shown in FIG. 2, the outer diameter of the aurora cover 28 is smaller than the diameter of the opening 142, so that the aurora cover 28 and the upper shell 14 are radially separated from an annular space for installing the lighting component 30. As shown in FIG. 5, the inner surface (that is, the surface facing the aurora sheet 26) of the aurora cover 28 is provided with a plurality of irregular plano-convex lenses 285; the number of the irregular plano-convex lenses 285 is not less than ten, and at least two-thirds thereof are irregularly elongated lenses, so that the light from the first lamp bead 22 can project light bands, starry sky and other effects after passing through the aurora sheet 26 and the aurora cover 28.

Preferably, the projection component 20 further comprises a motor 29; the motor 29 is drivingly connected to the aurora sheet 26 to drive the aurora sheet 26 to move. The motor 29 is fixedly connected to the bottom of the first circuit board 23 by screws or the like, and the output shaft of the motor 29 passes through the first circuit board 23 and is fixedly connected to the aurora sheet 26. The aurora sheet 26 is driven by the motor 29 to change the focal length of the irregular plano-convex lens above the lens, and change the focal length of the light passing through the aurora sheet 26 through the lens, so that the finally projected light band has a streamer effect. It should be understood that the specific structure of the convex lens of the aurora sheet 26 and/or the lens of the aurora cover 28 can be set according to the desired projection effect, which is not limited to the illustrated embodiment.

Figure 6:
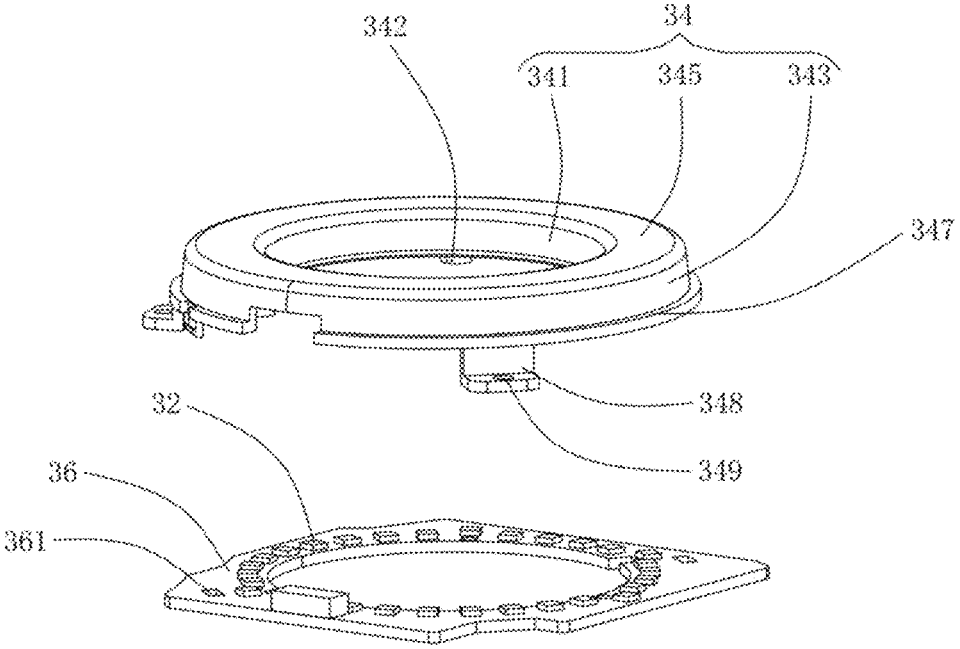
FIG. 6 is a further exploded view of the lighting component shown in FIG. 3.
Figure 7:
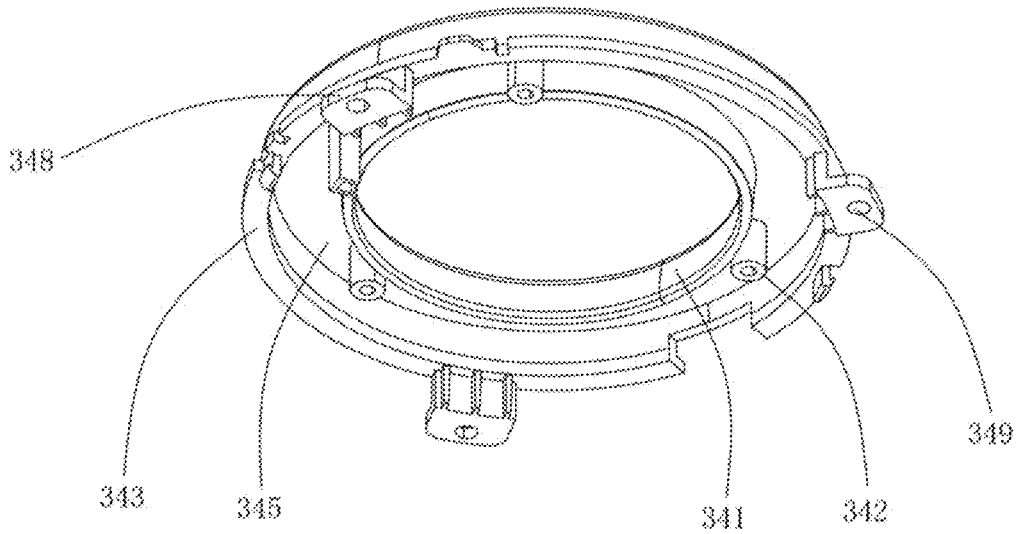
FIG. 7 is another angled view of the diffuser of the lighting component shown in FIG. 6.
Figure 8:
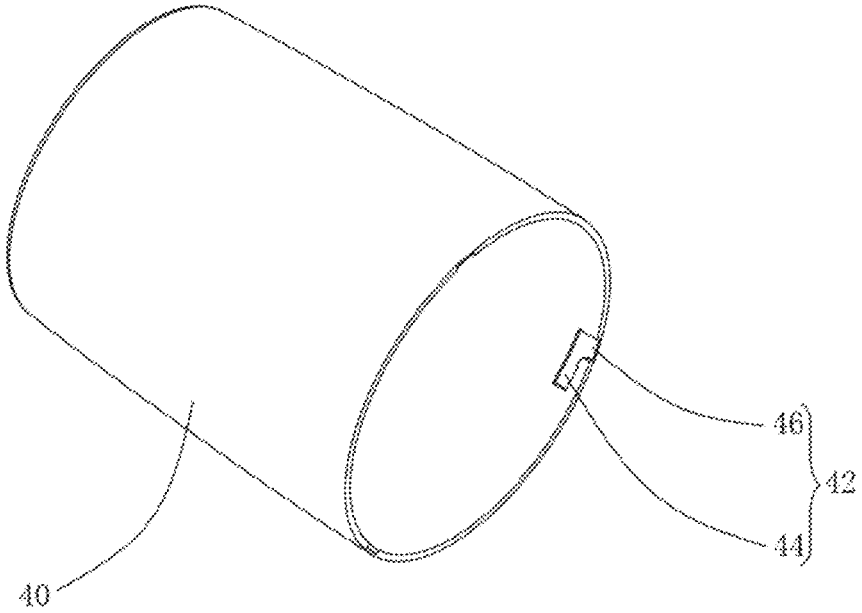
FIG. 8 is another angled view of the lamp cover shown in FIG. 3.

As shown in FIG. 6 and FIG. 7, the lighting component 30 comprises second lamp beads 32 and a diffuser 34 covered on the second lamp beads 32. The second lamp beads 32 are preferably LED lamp beads, and are fixedly connected to the second circuit board 36 by wire bonding or the like. The second circuit board 36 is a ring structure with a structure of outer square and inner circle, and its inner diameter matches the outer diameter of the aurora cover 28. The second lamp beads 32 are preferably multiple, and are arranged at even intervals along the circumferential direction of the second circuit board 36. The diffuser 34 also has a ring-shaped structure, and the cross-section thereof is roughly in a "∩" shape, comprising an inner plate 341, an outer plate 343 and a top plate 345 connecting the inner plate 341 and the outer plate 343, which are arranged at intervals; the inner plate 341 is connected to the upper shell 14, and the outer plate 343 is connected to the diffuser 34; the second circuit board 36 is disposed on the opening side of the diffuser 34 and the light from the second lamp bead 32 faces the top plate 345.

Specifically, the outer edge of the bottom of the aurora cover 28 extends radially outward to form a first folding 281; and the first folding 281 is provided with a first perforation 283; the second circuit board 36 is stacked on the first folding 281 and a second perforation 361 is formed at a position facing the first perforation 283; the inner plate 341 of the diffuser 34 is formed with a first convex column 342; the first convex column 342 is provided with an assembly hole; fixing parts such as screws and pins pass through the first perforation 283 of the aurora cover 28 and the second perforation 361 of the second circuit board 36 in sequence, and then are fixedly connected to the assembly hole of the diffuser 34 to connect the diffuser 34, the second circuit board 36 and the aurora cover 28 together. Preferably, the number of the first perforation 283, the second perforation 361, and the first protrusion 342 is multiple and they are arranged at intervals along the circumferential direction.

The outer plate 343 of the diffuser 34 extends radially outward to form a second folding 347; the second folding 347 overlaps the edge of the opening 142 of the upper shell 14, and the diffuser 34 can be pre-positioned in the up and down direction to facilitate subsequent assembly. The second folding 347 extends downward to form a mounting part 348; the mounting part 348 is formed with a third perforation 349; the upper shell 14 is provided with a second convex column 144 extending downward from the edge of the opening 142; a mounting hole is formed in the second convex column 144; fixing parts such as screws and pins pass through the third perforation 349 of the diffuser 34 and are fixedly connected to the assembly hole of the second protrusion 144 of the upper shell 14 to connect the diffuser 34 and the upper shell 14 together. Preferably, the number of the third perforation 349 and the second convex column 144 is multiple and they are arranged at intervals along the circumferential direction.

The lamp cover 40 is arranged on the upper shell 14 to cover the diffuser 34 of the lighting component 30 and the aurora cover 28 of the projection component 20. The lamp cover 40 is detachably connected to the upper shell 14, wherein a clamping slot 42 is formed on the inner surface of the lamp cover 40, and a clamping block 146 is formed on the upper shell 14 corresponding to the clamping slot 42. The clamping slot 42 is in a "¬" shape as a whole, including a transverse first notch 44 and a longitudinal second notch 46, wherein the bottom end of the second notch 46 penetrates the lower edge of the lamp cover 40, and the top end thereof is communicated with the first notch 44. In assembling, align the clamping block 146 with the second notch 46 and insert the clamping block 146 into the second notch 46 from the bottom end of the second notch 46; when the clamping block 146 moves upward along the second notch 46 to its top end, rotate the lamp cover 40 so that the clamping block 146 enters the first notch 44 until it moves to the end of the first notch 44; at this time, since the first notch 44 is closed in the longitudinal direction, the lamp cover 40 will not fall off automatically.

When the lamp cover 40 needs to be removed, turn the lamp cover 40 in the opposite direction so that the clamping block 146 moves to the position of the second notch 46, then pull the lamp cover 40 upwards to make the clamping block 146 separate from the clamping slot 42 from the bottom end of the second notch 46, and the lamp cover 40 can be removed. In the invention, through the detachable connection of the lamp cover 40 and the shell 10, the entire projection night light have a variety of different use effects: when the lamp cover 40 is removed, the first lamp bead 22 can be turned on for use as a projection lamp, or the second lamp bead 32 can be turned on for use as an illuminating lamp; when the lamp cover 40 is installed, the lamp cover 40 has a specific effect on the light; at this time, the first lamp bead 22 is turned on to form a flame effect, and the second lamp bead 32 is turned on to form a luminous effect. In this way, the user can select an appropriate usage mode according to the specific usage time and application scenarios, so that the projection night light of the invention can be used for multiple purposes.

Preferably, the shell 10 is further provided with a main control circuit board 50; the main control circuit board 50 is electrically connected to the first circuit board 23 and the second circuit board 36 through wires or the like, and controls the operation of the first lamp bead 22 and the second lamp bead 32 according to the user's instruction. As shown in the figure, the main control circuit board 50 is arranged in the bottom shell 12 below the first circuit board 23, and a control switch can be provided on the bottom shell 12 to input the user's instruction. Preferably, the bottom shell 12 is further provided with a sounding device 52, such as a horn, etc.; the sound device 52 is connected to the main control circuit board 50, and plays different music according to different lighting effects to further render the atmosphere, such as playing soft music under the luminous effect and warm music under the flame effect, which bring people physical and mental pleasure.

The projection night light of the invention is equipped with a projection component 20 and a lighting component 30, wherein the lighting component 30 is arranged around the projection component 20 so that the light paths of the two will not affect each other. In addition, the match of the lamp cover 40 allows the invention to have a variety of different ways of use. The detachable connection of the lamp cover 40 and the shell 10 makes the switching of various modes simple and convenient, which can conveniently create atmosphere for users, decorate the room, assist sleep, etc., and is worthy of vigorous promotion and use.

It should be noted that the invention is not limited to the above embodiments. According to the creative spirit of the invention, those skilled in the art can also make other modifications, which shall all fall within the protection scope claimed by the invention.

The invention claimed is:

1. A projection night light, comprising:

a shell, and a projection component and a lighting component arranged in the shell, wherein the projection component comprises a first lamp bead and an aurora cover covered on the first lamp bead; the lighting component comprises second lamp beads and a diffuser covered on the second lamp beads; the diffuser is in a ring shape and is arranged around the aurora cover; a center of the shell is provided with an opening; the aurora cover and the diffuser extend out of the shell from the opening;

wherein the second beads are multiple and arranged at intervals around the aurora cover.

2. The projection night light according to claim 1, wherein the projection component further comprises a condenser lens arranged on the first lamp bead.

3. The projection night light according to claim 2, wherein the projection component further comprises an aurora sheet provided between the condenser lens and the aurora cover, and a motor drivingly connected to the aurora sheet.

4. The projection night light according to claim 3, wherein the motor and the first lamp bead are connected to a first circuit board and are respectively arranged on opposite sides of the first circuit board.

5. The projection night light according to claim 1, wherein the second lamp beads are connected to a second circuit board, the second lamp beads are arranged on the second circuit board; the second circuit board surrounds the aurora cover; the multiple second lamp beads are arranged at intervals along the circumferential direction of the second circuit board.

6. The projection night light according to claim 5, wherein the diffuser comprises an inner plate, an outer plate and a top plate connecting the inner plate and the outer plate; the inner plate is fixedly connected to the second circuit board and the aurora cover; the outer plate is fixedly connected to the shell; the second lamp bead is arranged toward the top plate.

7. The projection night light according to claim 1, comprising a sounding device provided in the shell.

8. The projection night light according to claim 1, wherein the bottom of the shell is provided with a non-slip mat.

9. The projection night light according to claim 1, comprising a lamp cover detachably connected to the shell; the lamp cover covers the aurora cover and the diffuser.

10. The projection night light according to claim 9, wherein the shell is protrudingly provided with a clamping block; the lamp cover is provided with a clamping slot corresponding to the clamping block; the clamping slot is in the shape of "]" and a bottom end of the clamping slot penetrates a bottom edge of the lamp cover.

* * * * *